United States Patent [19]

Sijthoff

[11] 4,150,502

[45] Apr. 24, 1979

[54] METHOD AND APPARATUS FOR BREAKING UP LUMPS OF STONE FROM A SUBAQUEOUS SOIL

[75] Inventor: Jan Piet t. Sijthoff, Amstelveen, Netherlands

[73] Assignees: Ballast-Nedam Groep N.V.; Amsterdamse Ballast Bagger en Grond; B.V. en Scheepswerf en Machinefabrick "de liesbosch" B.V., all of Amsterdam, Netherlands

[21] Appl. No.: 751,194

[22] Filed: Dec. 16, 1976

[30] Foreign Application Priority Data

Dec. 19, 1975 [NL] Netherlands ..... 7514881

[51] Int. Cl.[2] ..... E02F 3/88

[52] U.S. Cl. ..... 37/58; 37/195; 172/177; 172/554; 299/18; 299/40

[58] Field of Search ..... 37/54, 57, 58, 61–63, 37/66, 72, 195, DIG. 8; 172/271, 264, 265, 180, 149, 174, 177, 179, 180, 192; 299/10, 18, 39, 36, 37, 86, 40

[56] References Cited

U.S. PATENT DOCUMENTS

| | | | |
|---|---|---|---|
| 127,757 | 6/1872 | Friberg | 172/271 |
| 196,646 | 10/1877 | Eads | 37/62 |
| 206,120 | 7/1878 | Megquier | 299/40 X |
| 233,056 | 10/1880 | Wimpee | 172/177 |
| 262,828 | 8/1882 | Peterson | 172/149 X |
| 657,568 | 9/1900 | Robinson | 37/58 |
| 660,956 | 10/1900 | Henderson | 37/66 |
| 1,840,606 | 1/1932 | Scheffauer | 37/58 |
| 2,113,666 | 4/1938 | Suman | 172/271 UX |
| 3,760,882 | 9/1973 | Geurts | 172/265 |
| 3,999,313 | 12/1976 | Andrews | 37/DIG. 8 |

FOREIGN PATENT DOCUMENTS

| | | | |
|---|---|---|---|
| 971580 | 7/1975 | Canada | 37/58 |
| 71744 | 2/1953 | Netherlands | 299/37 |
| 1383089 | 2/1975 | United Kingdom | 37/72 |

*Primary Examiner*—Clifford D. Crowder
*Attorney, Agent, or Firm*—John P. Snyder

[57] ABSTRACT

When breaking up lumps of stone from a subaqueous stony ground, the lumps are loosened by means of at least one chisel inserted into the ground and being moved along the ground surface. In order to break up lumps of stone by low power and to main a predetermined size of the loosened lumps of stone suitable for being lifted by a suction dredger system, the structure of the top layer of the stony ground is disturbed by inserting displacers from above into the ground at places distributed over the ground surface.

15 Claims, 18 Drawing Figures

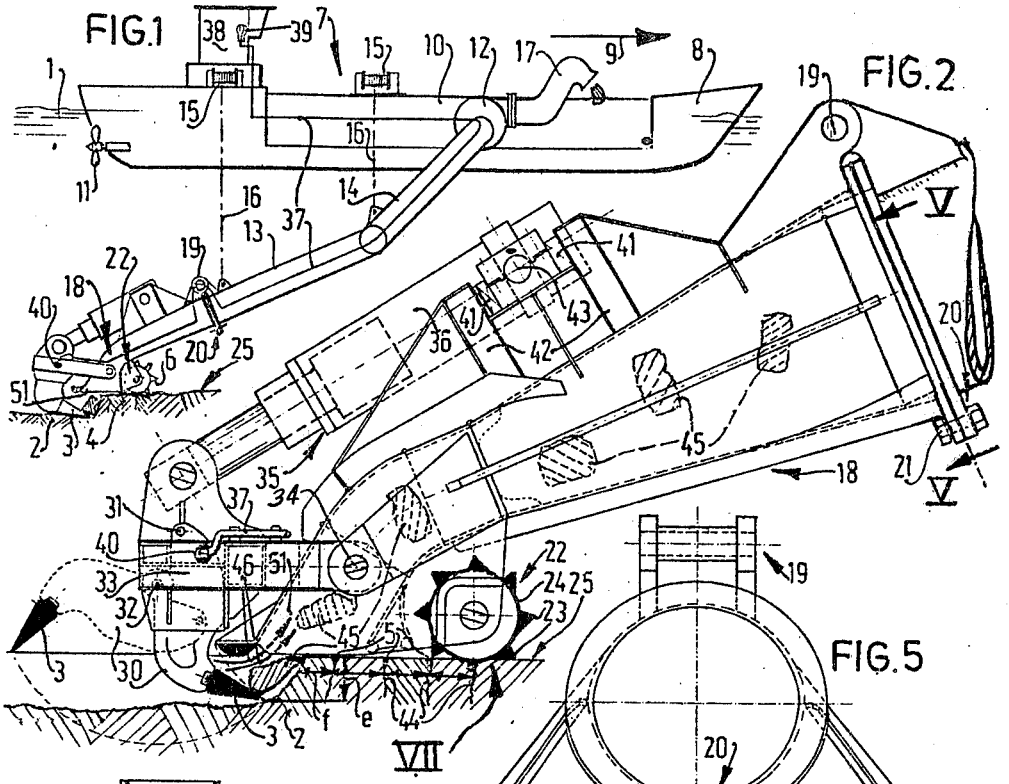
FIG.1
FIG.2
VII
V
V
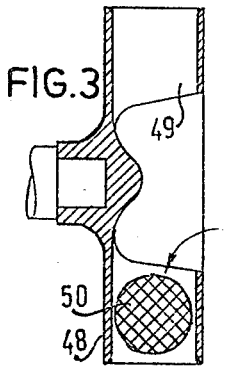
FIG.3
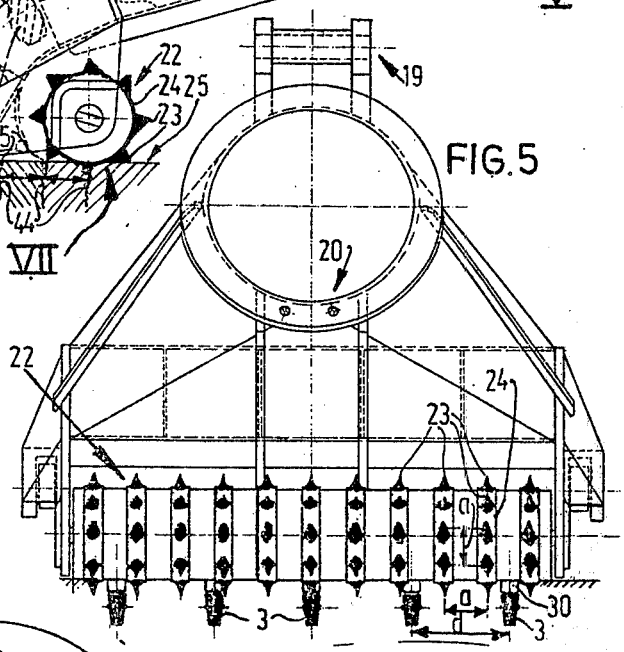
FIG.5
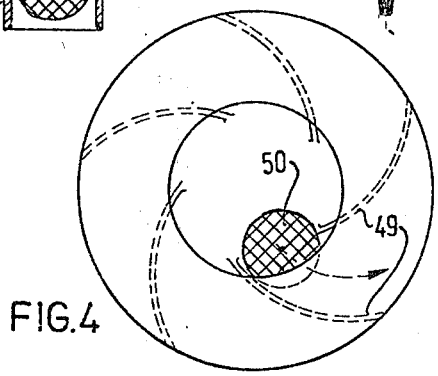
FIG.4
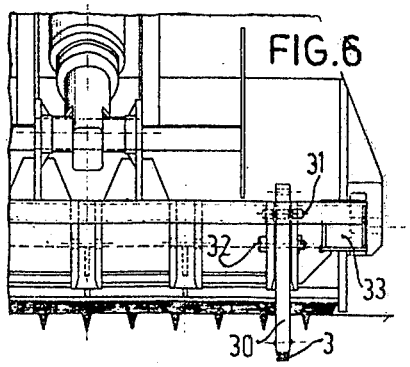
FIG.6

FIG.9
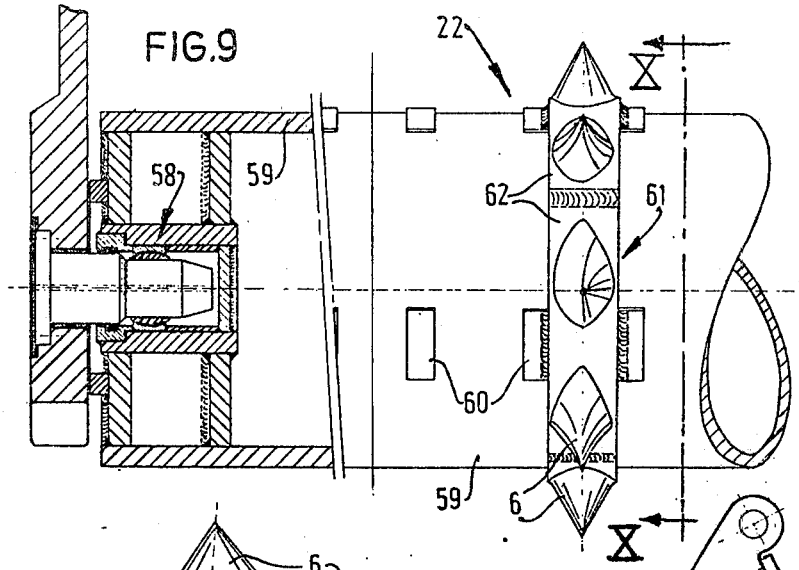
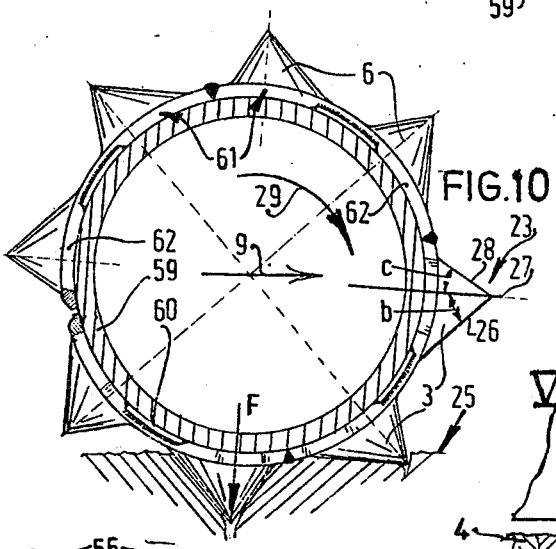
FIG.10
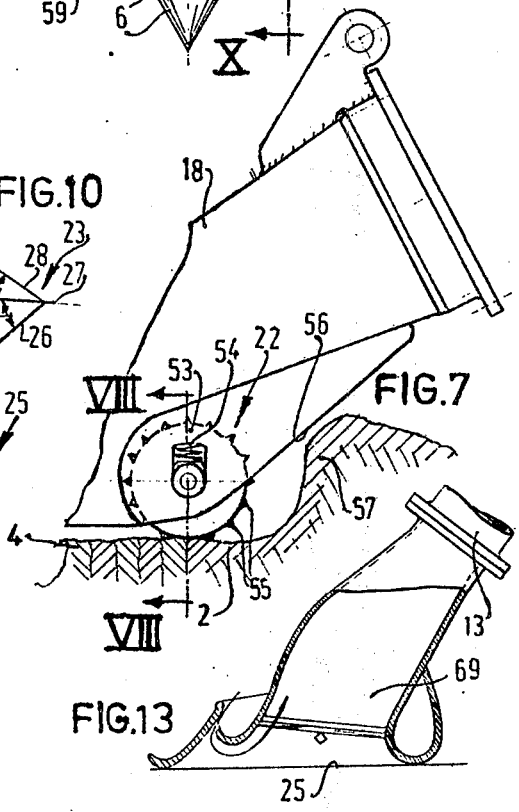
FIG.7
FIG.13
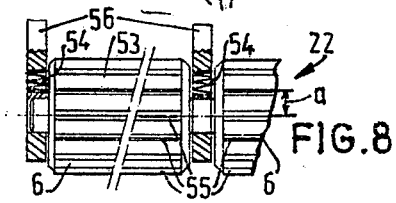
FIG.8
FIG.11
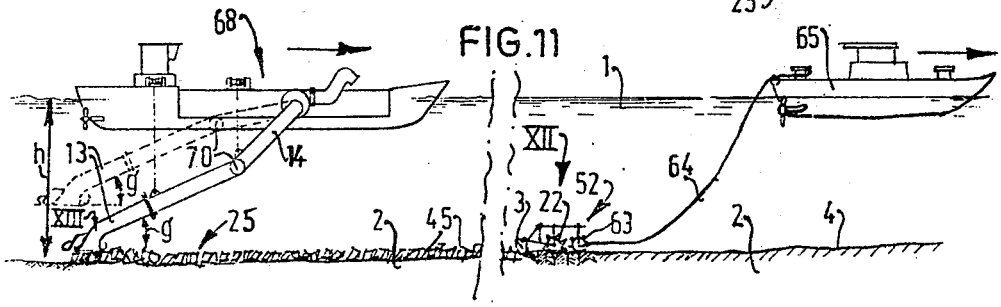

33
35
64
52
66
6
36
67
30
45
2
81
4
3
32
22
62
63

74

65
1
13
10
14
XV
71
64
75
XVI
72
6
25
2
45
4
3

71
64
6

73
72

35
75
77

4
2
25
30
3
45
76

78
1

9
XVIII
79
80
22
2

79
13

22
80
6
2
3
82

METHOD AND APPARATUS FOR BREAKING UP LUMPS OF STONE FROM A SUBAQUEOUS SOIL

The invention relates to a method of breaking up lumps of stone from a subaqueous, stony soil, the lumps being loosened by means of at least one chisel penetrating into the ground and moved along a path substantially parallel to the ground surface.

Such a method is known. In the known methods the virginal ground is worked by the chisel. It requires heavy forces to loosen the lumps of stone, whilst the lifetime of the chisel is short due to heavy wear and/or breakage. Moreover, the loosened lumps of stone have highly different sizes. The removal of large lumps cannot be performed, for example, by means of a suction dredger system.

The invention has for its object to provide the possibility of breaking up lumps of stone by low power to maintain a predetermined size of the loosened lumps of stone suitable for being lifted by a suction dredger system. According to the invention the structure of the top layer of the stony ground is disturbed by inserting displacers from about into the ground at places distributed over the ground surface.

The invention furthermore provides a device for breaking up lumps of stone from a stony, subaqueous ground, said device comprising at least one chisel to be inserted into the ground and a carrier for said chisel and means for moving the chisel along a path substantially parallel to the ground surface, said device being characterized by a displacer tool having a plurality of displacers mounted thereon at relative distances.

The above mentioned and further features of the invention will be explained more fully in the following description with reference to a drawing.

In the drawing

FIGS. 1,11,14 and 17 illustrate schematically a method embodying the invention, each time, with a different device in accordance with the invention.

FIG. 2 is an enlarged elevation of a suction nozzle of FIG. 1.

FIG. 3 is partly an axial section view of the impeller of a pump shown in FIG. 1.

FIG. 4 is an elevational view of FIG. 3.

FIG. 5 is an elevational view taken in the direction of the arrows V—V in FIG. 2, FIG. 6 is only part of the rear view of the device of FIG. 2.

FIGS. 7 and 9 show each a variant of detail VII in FIG. 2. FIG. 8 is an elevational view taken in the direction of the arrows VIII in FIG. 7.

FIG. 10 is a sectional view taken on the line X—X in FIG. 9.

FIG. 13 is an enlarged sectional view of detail XIII of FIG. 11.

Figure 12:
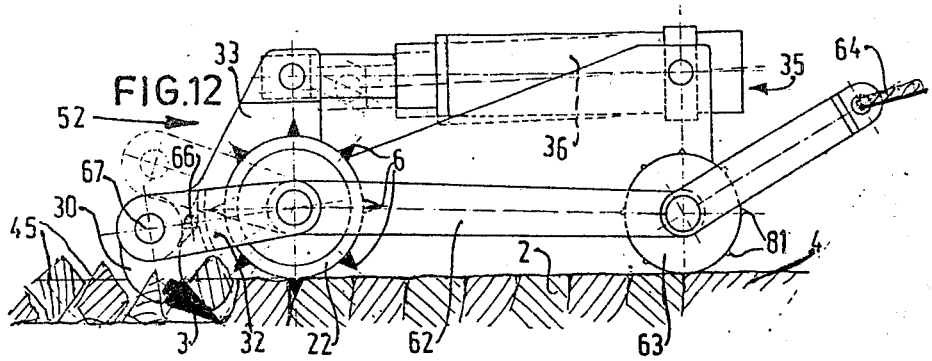
FIG. 12 is an enlarged side elevation of detail XII of FIG. 11.

By each of the methods illustrated in FIGS. 1,11,14 and 17 (see in particular FIG. 2) embodying the invention lumps of stone are broken up from a stony ground 2 beneath the water 1 by means of at least one, but preferably a series of chisels 3 arranged side by side at a distance from one another to be inserted into the ground 2. The structure of the top layer 4 of the stony ground 2 is disturbed by inserting displacers 6 into the ground 2 at places distributed over the ground surface.

The device shown in FIGS. 1 to 6 comprises a suction dredger system 7 comprising a vessel 8 having propelling means, for example, a driven screw 11, travelling in the direction 9 and having a hold 10, a pump 12, a suction tube 14 connected with the pump 12 and pivotally suspended to the vessel 8, a suction tube 13 pivotally connected herewith, a tugged suction head 18 and a displacer tool 22 arranged at the front of the tugged suction head 18, viewed in the direction of travel 9. The position of the suction tubes 13 and 14 is variable by means of winches 15 and cables 16. A pressure duct 17 connects the pump 12 with the hold 10. The suction head 18 is adapted to deflect pivotally about a superjacent hinge 19 and connected with the suction tube 13. A subjacent connection 20 formed by two breaking bolts 21 allows, in the event of overload, an upward pivotal deflection of the suction head 18 about the hinge 19. The suction head 18 forms a frame carrying the chisels 3 as well as the displacer tool 22 having a plurality of displacers 23 at a relative distance a. The displacer tool 22 is formed by a roller adapted to roll along the gound surface 25 and being provided at its sheath 24 with the displacers 23 formed by pins tapering to a tip. The displacers 23 shown in FIGS. 1 to 6 have the shape of slanting cones, whose front surface 26—viewed in the direction of rotation 29—is at an angle b of 45° to the radial line 27 whereas the rear surface 28 is at a smaller angle c of, for example, 30° to the radial line 27.

The displacers 23 are made of cast steel having an admissible tension of 4000 kgsf/cm$^2$; they are inserted each with a vertical force F of, for example, 40,000 to 50,000 kgsf into the ground surface 25. Their length may be 7.5 cms.

This device according to the invention is suitable for working a stony ground, for example, of sandstone and lime stone having a fission resistance of 100 kgsf/cm$^3$; for this fission chisels 3 can each absorb a horizontal force of 36 tons f for working a strip of ground having a width d of 55 cms, whilst the penetration depth of the chisels e is 25 cms.

The device embodying the invention comprises furthermore a plurality of separate chisel carriers 30 having each a chisel 3 and being connected with a pivotable frame 33 of a tugged suction head 18 via a breaking element formed by a breaking pin 31 and a hinge 32. In the event of overload of the breaking pin 31 a chisel carrier 30 can turn about its hinge 32 with respect to the pivotable frame 33 and thus deflect with respect to the suction head 18. The frame 33 itself is capable of turning about hinges 34 with respect to the suction head 18 against the pressure of a spring element 35 comprising a strongly compressed gas cushion 36. When a predetermined value is exceeded by overload the pivotable frame 33 turns and all chisels 3 withdraw from the ground 2. Subsequently, the spring element 35 gradually urges the chisels 3 again into the ground 2.

Sensing means formed, for example, by an electric conductor 37, signallize the breakage of the breaking pin 31 and are coupled with an indicator 39 disposed at the control-panel 38 of the vessel 8. A conductor 37 is passed through a hole 40 of each chisel carrier 30 and in the event of a turn of the chisel carrier 30 with respect to the frame 33 this conductor is broken.

With respect to the suction head 18 the frame 33 is adjustable, since the hinge shaft 43 of the spring element 35 is displaceable in the axial direction of the spring element 35 between supports 42 by means of spacer plates 41. Thus the penetration depth e of the chisels 3 can be varied.

The device used in the method shown in FIGS. 1 to 6 operates as follows.

Whilst the vessel 8 is driven by the screw 11 in the direction of travel 9, the suction head 18 carrying the displacer tool 22 is coupled with the vessel 8 via the suction tubes 14 and 13 forming tug means, so that the suction head 18 is tugged along whilst rolling by the roller along the ground surface 25, on which it exerts heavy pressure. As a result the displacers 6 are inserted into the top layer 4, in which grooves or vertical fractures 44 are made at uniform intervals f, along which breakage takes place, since the chisels 3 are moved in a path substantially parallel to the ground surface 25, the top layer 4 being thus cut from the ground 2. Thus loose lumps of stone 45 are formed to a size suitable for being sucked up. The lumps of stone 45 are so small that they can be handled by the suction dredger system 7. The lumps can enter the suction nozzle 51 of the suction head 18 located between the chisels 3 and the displacer tool 22 and be transported upwards owing to the suction force of the pump 12 by the according to arrows 46 high rate of flow of the water 1, and, moreover, they can pass through a rotor 48 (FIGS. 3 and 4) of the pump 12 having blades 49 because the outer dimensions of the lumps of stone 45 remain within the sphere 50 illustrating a lump of maximum workable size. Through the suction head 18, the suction tubes 13 and 14, the pump 12 and the pressure duct 17 the lumps of stone 45 get into the hold 10.

The suction head 18 shown in FIGS. 7 and 8 differs from that shown in FIGS. 1 to 6 in that the displacer tool 22 is formed by a series of rollers 53 journalled in more than two cheeks 56 and adapted to deflect upwardly against strongly biased springs 54, if the ground 2 to be worked were too hard. With this displacer tool 22 the displacers 6 are formed by longitudinal rulers 55 extending parallel to and at a distance a from one another. The cheeks 56 constitute a forwardly inclined screen at the front of the suction head 18 to protect the device from collisions with elevations 57 of the ground.

The displacer tool 22 shown in FIGS. 9 and 10 is formed by a roller journalled at both ends in a spherical caster bearing 58 so that the displacer tool 22 can unobjectionably deform elastically. The sheath 59 of the roller has fastened to it welding plates 60 for welding castings 61 thereto, each of which is formed by a ring portion 62 and two displacers 6 moulded thereon.

FIG. 11 illustrates a method in which the lumps of stone 45 are first broken out of the ground 2 because a frame 52 bearing on a displacer tool 22 formed by a roller and on a ground roller 63 and being provided with chisels 3 is coupled by a cable 64 forming tow means with a tugboat 65 dragging said frame 52. The carriers 30 of the chisels 3 are each pivotally fastened to a frame 33 via a breaking bolt 66 and a hinge 67, said frame being upwardly pivotable against the action of a spring 35 having a gas cushion 36. The ground roller 63 is provided with short displacers 81, which irritate the top layer 4, be it to a lesser extent than the displacers 6. After the lumps of stone 45 have been loosened from an appreciable surface of the ground 2 by rolling the frame 52 along parallel, contiguous strips, the lumps of stone 45 are lifted by a conventional suction dredger system 68, comprising a tugged suction head 69 as shown in FIG. 13. The suction head 69 is rigidly secured to the suction tube 13 and is held directly on the ground surface 25 by adjusting the level of the hinge 70 between the suction tubes 13 and 14 in dependence upon the suction depth h so that the angle g between the suction tube 13 and the horizontal remains constant.

Figure 14:
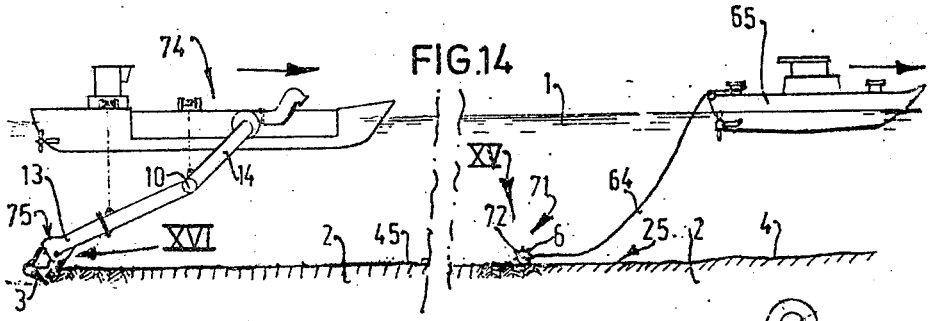
Figure 15:
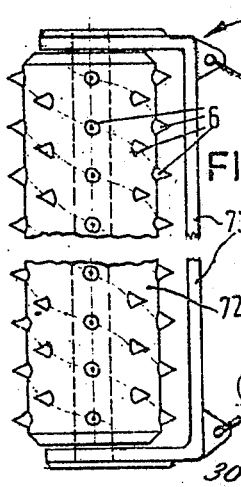
FIG. 15 is an enlarged plan view of detail XV in FIG. 14.
Figure 16:
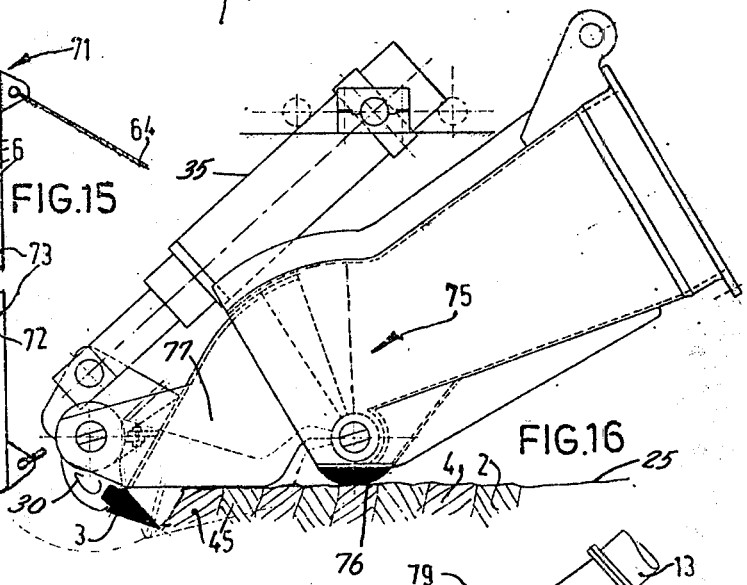
FIG. 16 is an enlarged elevational view of detail XVI of FIG. 14.

In the method illustrated in FIG. 14 the ground 2 is first irritated by means of a displacer tool 71 mainly comprising a roller 72 having a tow bracket 73, which is dragged on by a tow cable 64 of a tugboat 65, the conical displacers 6 relatively off-set in an axial direction penetrating from above during the rolling movement into the ground surface 25. After this irritation the ground 2 is worked by a suction dredger system 74 comprising a tugged suction head 75 of the kind shown in FIG. 16. This suction head 75 bears by a split member 76 on the ground surface 25 and has a direction finder 77 capable of deflecting upwardly against the action of a spring 35 and having fastened to it carriers 30 for chisels 3. This suction head 75 loosens to lumps of stone 45 from the upper layer 4 and lifts them by suction.

Figure 17:
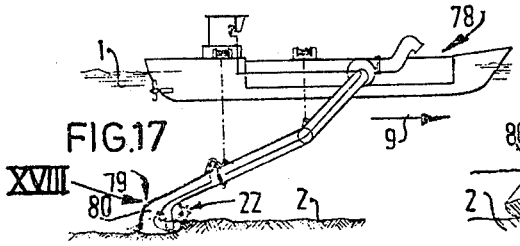

The suction dredger system 78 shown in FIG. 17 comprises a suction head 79, whilst viewed in the direction of travel 9 the suction nozzle 80 is disposed behind the chisels 3 and the displacer tool 22.

Figure 18:
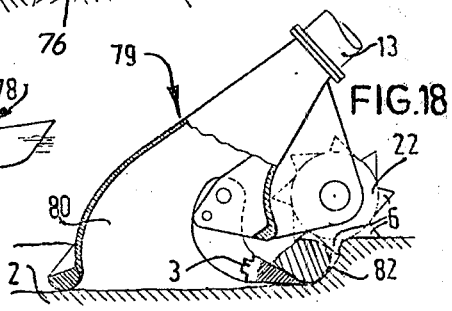
FIG. 18 shows on an enlarged scale detail XVIII of FIG. 17.

The chisels 3 and the displacers 6 simultaneously attack the groove faces 82 (see FIG. 18) which results with special kinds of stone in a particularly satisfactory breaking effect.

What we claim is:

1. A suction dredger assembly for dredging subaqueous stony ground, comprising in combination:

suction tube means adapted to be attached at one end to a dredger hull and having a suction head defining a suction mouth at its other end;

freely rotatable means carried by said suction head for supporting at least a portion of the weight of the suction dredger assembly on the surface of the subaqueous ground whereby to bear upon the ground surface and to position said suction mouth above such surface so that it moves along over the surface along a path determined by movement of the hull, said freely rotatable means being positioned forwardly of said suction mouth and including a freely rotating member having transversely disposed and uniformly circumferentially spaced penetrating means which, by virtue of the bearing weight, penetrate the ground to a first depth successively along lines which are transverse to said prescribed direction and are uniformly spaced in said prescribed direction and which successively vertically fracture the ground along such lines at least to a predetermined second depth substantially greater than said first depth; and chisel means carried by said suction head below said suction mouth and behind said freely rotatable means for horizontally shearing the ground at a level corresponding to said second depth below the surface thereof to which the vertical fracturing reaches.

2. Apparatus as defined in claim 1 wherein said penetrating means is in the form of a plurality of transverse rows of conical members, each conical member presenting a front surface, viewed in the direction of rotation of the roller, is at an angle of about 45° with respect to a radial line passing through the tip of the cone and a rear surface which is at an angle about 30° with respect to such radial line.

3. Apparatus as defined in claim 2 wherein each conical member bears against the formation with a vertical force in the order of 40,000 to 50,000 kgsf.

4. Apparatus as defined in claim 3 wherein the radial length of each conical member is in the order of 7.5 cms.

5. Apparatus for reducing subaqueous formations such as sandstone, limestone and the like to lumps sized such that they may be removed by suction dredging, said apparatus comprising:

freely rotatable roller means for vertically fracturing the subaqueous formation along lines which extend transversely across and are regularly spaced longitudinally along a predetermined path;

means for pulling said roller means along said path;

said roller means comprising a freely rotatable roller having radially projecting penetrating means, said penetrating means projecting a predetermined length from said roller and being disposed to engage the subaqueous formation successively along said transverse lines as the roller freely rolls along said path while penetrating such formation and vertically fracturing it along said lines to a depth substantially greater than said predetermined length of the penetrating means; and chisel means connected to and behind said roller means for horizontally shearing the vertically fractured formation at that depth to which the vertical fracturing reaches, the regular spacing of said lines and the depth of horizontal shearing being such as reduces a top layer of the subaqueous formation to said lumps sized such that they may be removed by suction dredging.

6. Apparatus as defined in claim 5 wherein said penetrating means is in the form of a plurality of transverse rows of conical members, each conical member presenting a front surface, viewed in the direction of rotation of the roller, is at an angle of about 45° with respect to a radial line passing through the tip of the cone and a rear surface which is at an angle of about 30° with respect to such radial line.

7. Apparatus as defined in claim 6 wherein each conical member bears against the formation with a vertical force in the order of 40,000 to 50,000 kgsf.

8. Apparatus as defined in claim 7 wherein the radial length of each conical member is in the order of 7.5 cms.

9. The method of suction dredging subsqueous stony ground, which comprises the steps of:

(a) propelling a suction dredger hull in a prescribed direction above the subsqueous ground;

(b) towing a suction dredger assembly from the hull so that the nether end of the assembly bears upon said ground with predetermined force;

(c) supporting the bearing weight of said assembly by means of a freely rotating member having transversely disposed and uniformly circumferentially spaced penetrating means which, by virtue of the bearing weight, penetrate the ground to a first depth successively along lines which are transverse to said prescribed direction and are uniformly spaced in said prescribed direction and which successively vertically fracture the ground along such lines at least to a predetermined second depth substantially greater than said first depth;

(d) horizontally shearing the ground substantially at said second predetermined depth by means of a chisel attached to the suction dredger assembly displaced a selected distance behind said freely rotating member whereby lumps of less than a prescribed size are removed from the ground; and (e) dredging said lumps to said hull.

10. The method as defined in claim 9 wherein said second depth is in the order of 25 cms.

11. The method as defined in claim 10 wherein said first depth is not greater than about 7.5 cms.

12. A method of breaking up lumps of stone from a subaqueous stony ground, comprising the steps of:

(a) providing a roller having radially projecting elements disposed along transverse lines spaced uniformly circumferentially therearound;

(b) towing said roller from a floating hull so that the roller rolls freely along a path over the surface of a subsqueous body of stony ground so that said ground is vertically fractured by said elements at regularly spaced intervals along said path coinciding with the circumferential spacing of said lines;

(c) simultaneously with step (b), horizontally shearing the stony ground behind said roller at such a depth below said surface that the combination of the vertical fracturing and horizontal shearing reduces the surface of the stony ground along said path to lumps of desired size; and (d) removing said lumps by suction dredging.

13. A method of breaking up and removing lumps of stone from a subaqueous stony ground, comprising the steps of:

(a) providing a roller having radially projecting elements disposed along transverse lines spaced uniformly circumferentially therearound;

(b) towing said roller from a floating hull so that the roller rolls freely along a path over the surface of a subaqueous body of stony ground so that said ground is vertically fractured by said elements at regularly spaced intervals along said path coinciding with the circumferential spacing of said lines;

(c) subsequent to step (b), horizontally shearing the stony ground behind said roller at such a depth below said surface that the combination of the vertical fracturing and horizontal shearing reduces the surface of the stony ground along said path to lumps of desired size; and (d) removing said lumps by suction dredging.

14. The method as defined in claim 13 wherein said second depth is in the order of 25 cms.

15. The method as defined in claim 14 wherein said first depth is not greater than about 7.5 cms.

* * * * *